United States Patent [19]

Doyen et al.

[11] 4,371,159

[45] Feb. 1, 1983

[54] HANDLING INSTALLATION FOR BRINGING A PIECE TO A RECEIVING STATION IN A PREDETERMINED POSITION

[75] Inventors: Joël Doyen, Ste Savine; Jean-Pierre Raisin, Troyes, both of France

[73] Assignee: Agence Nationale de Valorisation de la Recherche, Neuilly sur Seine, France

[21] Appl. No.: 151,822

[22] Filed: May 21, 1980

[30] Foreign Application Priority Data

May 29, 1979 [FR] France ..... 79 13658

[51] Int. Cl.[3] ..... B65H 9/10; B65H 5/16

[52] U.S. Cl. ..... 271/228; 271/1; 271/268; 112/121.12

[58] Field of Search ..... 271/227, 228, 241, 251, 271/225, 267, 268, 269, 1, 84, 85; 112/121.12, 121.29

[56] References Cited

U.S. PATENT DOCUMENTS 3,434,439 3/1969 Winberg ..... 112/2

3,611,960 10/1971 Klein ..... 112/121.29

3,670,674 6/1972 Conner ..... 112/121.29

3,712,254 1/1973 Beamish et al. ..... 112/121.29

4,069,778 1/1978 Kozawa ..... 112/121.12

4,089,517 3/1978 Marass ..... 271/227 X

FOREIGN PATENT DOCUMENTS 2311128 12/1976 France .

*Primary Examiner*—Bruce H. Stoner, Jr.

*Attorney, Agent, or Firm*—Poms, Smith, Lande & Rose

[57] ABSTRACT

A handling device and installation for bringing to a second station, in a predetermined and fixed orientation and position, a piece, and in particular a supple piece in sheet form such as a fabric, situated in a first station in an approximative position. The installation includes photoelectric edge detectors for locating the position of the piece at the first station, drive motors for bringing and positioning a carriage opposite so-called gripping zones which are predetermined locations on the piece, and shoes for gripping the piece at the first station at the gripping zone and moving the piece to the second station whereby pieces of fabric are supplied in a predetermined orientation to a sewing station.

13 Claims, 19 Drawing Figures

HANDLING INSTALLATION FOR BRINGING A PIECE TO A RECEIVING STATION IN A PREDETERMINED POSITION

The present invention relates to a handling installation for bringing to a second station, in a predetermined and fixed orientation and position, a piece, and in particular a supple piece, in sheet form such as a fabric, situated in a first station in an approximate position.

SUMMARY OF THE INVENTION

An object of the invention is to disclose and provide an installation which is easy to use and which permits fast rates of work.

This object is attained according to the invention due to the fact that said installation comprises an installation including locating means for locating the position of the piece at the first station with respect to a fixed reference, correcting means for bringing and positioning gripping means provided on a transfer carriage opposite so-called gripping zones which are predetermined in the piece, said correcting means receiving positioning information supplied by the said locating means, the gripping means being capable of gripping the piece at the first station at the gripping zones, and moving the piece to the second station by a displacement of the carriage until the gripping zones are positioned at the second station in a position which corresponds with the desired predetermined position and orientation of the piece for sewing.

Advantageously, the displacement of the piece is effected by sliding it over a surface which also comprises the fixed reference.

Advantageously, this surface is planar.

Advantageously, the installation comprises means for storing in memory the positioning information supplied by the locating means and wherein the correcting means are capable of positioning the said gripping means opposite the predetermined gripping zones of the piece using the stored positioning information.

Advantageously, the installation further comprises orienting means for positioning the piece at the first station in a partially oriented position by orienting one edge thereof substantially in parallel with the predetermined orientation by determining the co-ordinates of a conspicuous reference point of the piece relative to the fixed reference.

Advantageously, in the case where the piece when viewed along a line perpendicular to its plane has at least one rectilinear edge, the orienting means are capable of positioning that edge along a predetermined reference line of the first station, thereby simplifying the determination of the co-ordinates of the reference point of the piece.

Generally stated, the installation of the present invention comprises a sliding plane extending between first and second stations, on which a piece can slide; a transfer carriage which is movable over the sliding plane between a first end-of-stroke position wherein the carriage is positioned at the first station and a second end-of-stroke position wherein the carriage is positioned at the second station, the transfer carriage including a guiding slide having detachable gripping means ensuring its connection to the piece resting on the sliding plane, the second end-of-stroke position of the transfer carriage is translationally fixed whereas the first end-to-stroke position is adjustable in a plane parallel to the sliding plane; locating means to determine the position of the piece at the first station with respect to a fixed reference point; memory means for storing and mechanically remembering positioning information supplied by the locating means; and correcting means for adjusting the first end-of-stroke position of the carriage in response to the positioning information so that the relative position of the transfer carriage when in the first end-of-stroke position with respect to the position of the piece at the first station is identical to the relative position of the transfer carriage when in the second end-of-stroke position with respect to the desired or intended predetermined fixed position of the piece at the second station.

The locating means further comprises at least three detectors mounted on a common support or detector carriage which is movable in translation within a plane parallel to the sliding plane in two non-parallel directions within said plane, the detectors being mounted on the common support in positions corresponding to the apices of a triangle in the plane of the sliding plane of which two sides are parallel to each of the directions of displacement, respectively; correcting means are provided for moving the support independently in each of the two directions in response to indications given by the detectors, such that the support only stops when it aligns with the apex of an angle formed by the edge of the piece, one of the said directions of displacement being parallel to one edge of the piece in its predetermined fixed position, said edge defining with an adjacent edge an angle having a point of intersection which constitutes the reference point of the piece; and transmitting means for transmitting to the correcting means information on the position of the support with its plane of motion.

Advantageously, the installation further includes orienting means for orienting the piece at the first station in parallel to the said predetermined rotational orientation.

Advantageously, the handling installation includes a frame and the transfer carriage for moving the piece from the first to the second station further comprises a guiding slide extending substantially parallel to the table which extends from the first station to the second station and mounted on the frame for rotation about a fixed axis situated at the second station; a driving carriage which is movable in parallel to the table from the first station to the second station which can be connected with the piece on the table and is guided along the guiding slide via an element of the transfer carriage which is engaged in said slide, the end-of-stroke position of the carriage at the second station, so-called receiving position, being a position in which the carriage element is aligned with the fixed axis of rotation of the slide, and driving means for positioning the driving carriage relative to the piece.

Advantageously, the installation further comprises a planar table, preferably horizontal, extending from the first station to the second station over which the piece can slide and wherein the correcting means is for adjusting : (a) the position of the slide by rotating it about the fixed axis relative to the starting position of the piece so that the lateral distance between the said piece in that starting position and the guiding slide remain substantially equal to the distance, so-called reference distance, existing between the guiding slide and the piece when the piece is in its predetermined desired receiving position at the second station; and (b) the first end-of-stroke position of the carriage at the first station in relation to the starting position of the piece, so that the distance between the starting position of the piece and the carriage in the first end-of-stroke position is substantially equal to the distance between the receiving position of the piece and the carriage in its second end-of-stroke receiving position.

Advantageously, the installation further includes orienting means for depositing on the table at the first station a piece taken from a preceding third station in an approximate position and for guiding in to the predetermined orientation, the orienting means being means for defining the position of a so-called reference point of the piece at the first station, and the flattening carriage being made to keep a fixed direction.

Advantageously, the orienting means includes at least two detectors, each one placed in a respective point, so-called detecting point, of the table at the first station, and each one detecting the presence of the piece at said point; gripping and transfer means for gripping the piece situated at a third station in an approximate position by at least two so-called gripping points on an edge of said piece and for moving the said edge above the table and low enough so that another so-called reference edge of the piece trails on said table in order to be able to be detected by each one of the said detector points, said gripping and transfer means each being controlled by its respective detector so as to release, independently one from the other, each of the said gripping points of the piece as soon as the detector adjacent the gripping point detects the passage from its proximity of the reference edge.

Advantageously, the portion of the table situated at the first station is circular and selectively pivots about its axis in response to associated driving means for driving it in rotation.

Advantageously, the slide is rectilinear.

Advantageously, the correcting means includes a connecting rod, pivotally joined on the one hand to a transverse slide situated at the first station and, on the other hand, to a support carriage guided on the frame transversely to the direction of displacement of the pieces on the table said support carriage being further adapted to follow the displacement of the common support of the locating means.

Advantageously, the support carriage supports a longitudinal slide placed substantially in line with the longitudinal axis of the table, on which slide is slidably mounted the common support for the locating means.

Advantageously, the connecting rod joining the support carriage to the guiding slide provided for the transfer carriage remains parallel to the direction of travel of the fixed axis of rotation of the connecting rod toward the receiving position of the reference point of the piece. A jointed parallelogram is constituted by means of a second connecting rod parallel to the first and connecting the guiding slide to an intermediate support which is itself pivotally mounted on the support carriage about the axis of the joint of the first connecting rod with the support carriage, said intermediate support and the slide constituting the remaining two opposing sides of the jointed parallelogram.

Advantageously, the slide carrying the joint support for the positioning means is mounted on the said intermediate support and it is oriented in parallel to the guiding slide which is guiding the driving carriage.

The invention will be better understood upon reading the following detailed description with reference to accompanying drawings, in which:

DETAILED DESCRIPTION OF A PREFERRED EXEMPLARY EMBODIMENT

Figure 1:
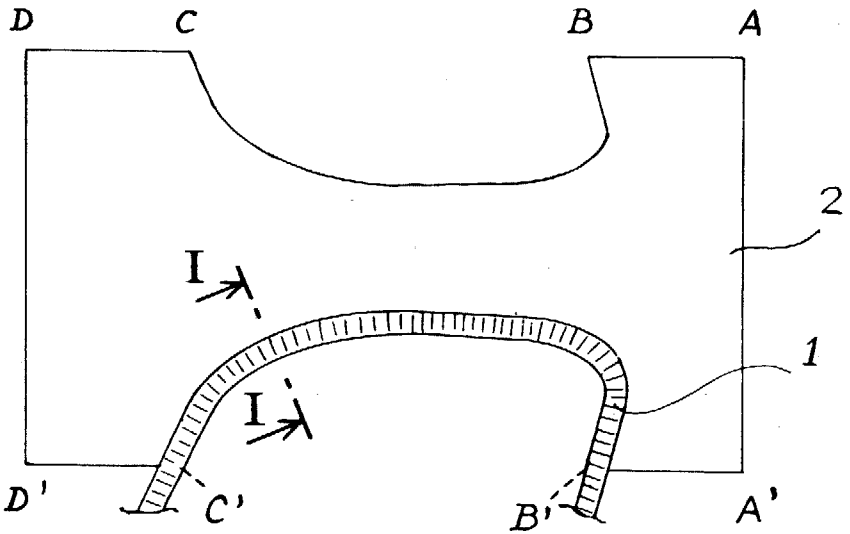
FIG. 1 is a plan view of a piece intended for the manufacture of underpants, and to be handled in accordance with the process of the invention.
Figure 1A:
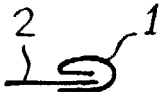
FIG. 1*a* is a cross-section taken along line I—I of FIG. 1.

The cording of the two concave edges of a piece of fabric used to make a pair of underpants is an operation which consists of placing and sewing in place a band 1 astride and along the two border edges BC and B'C' of a piece of fabric 2 (FIGS. 1 and 1*a*).

Said edges BC and B'C' of said piece 2 are concave curves, that is to say that their centers of curvature are situated outside the piece 2.

Figure 2:
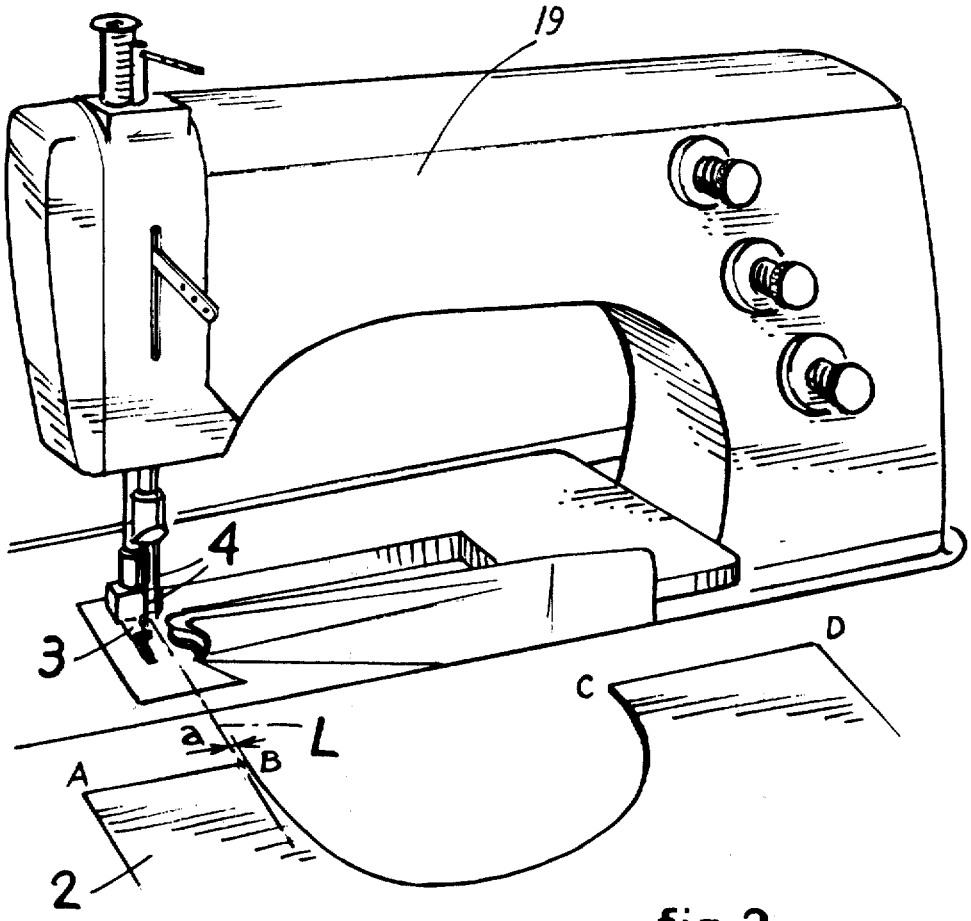
FIG. 2 is a perspective view of a sewing station to be supplied with pieces for sewing by the invention.

This sewing operation is commonly done by hand on a cording machine 19 such as is diagrammatically shown in FIG. 2. As is known in the art, a cording guide may be placed in front of the sewing machine which ensures the folding and accurate presentation of the band to the machine such that the band is automatically moved forward by the driving members of the sewing machine and sewn in place.

In this sewing operation, the articles stacked approximately in a pile are picked up one by one and then deposited flat in front of the presser foot 3 of the sewing machine and the beginning of the edge to be bordered BC or B'C' is engaged under the presser foot 3.

As shown in FIG. 2 the presentation of the article 2 under the presser foot 3 requires a certain accuracy; the introduction should be done so that point B of the edge BC and the tangent of the beginning of that edge are aligned parallel to the sewing line or axis L of the machine and displaced therefrom by only a small distance "a", for example equal at the most to 1.5 mm (value determined experimentally and due to the distance between the needles and to the strip width normally used) as shown in FIG. 2.

Secondly, the article 2 is guided under the needles 4 so that the local tangent of the edge BC or B'C' is always in the same direction as the sewing axis L.

Figure 3:
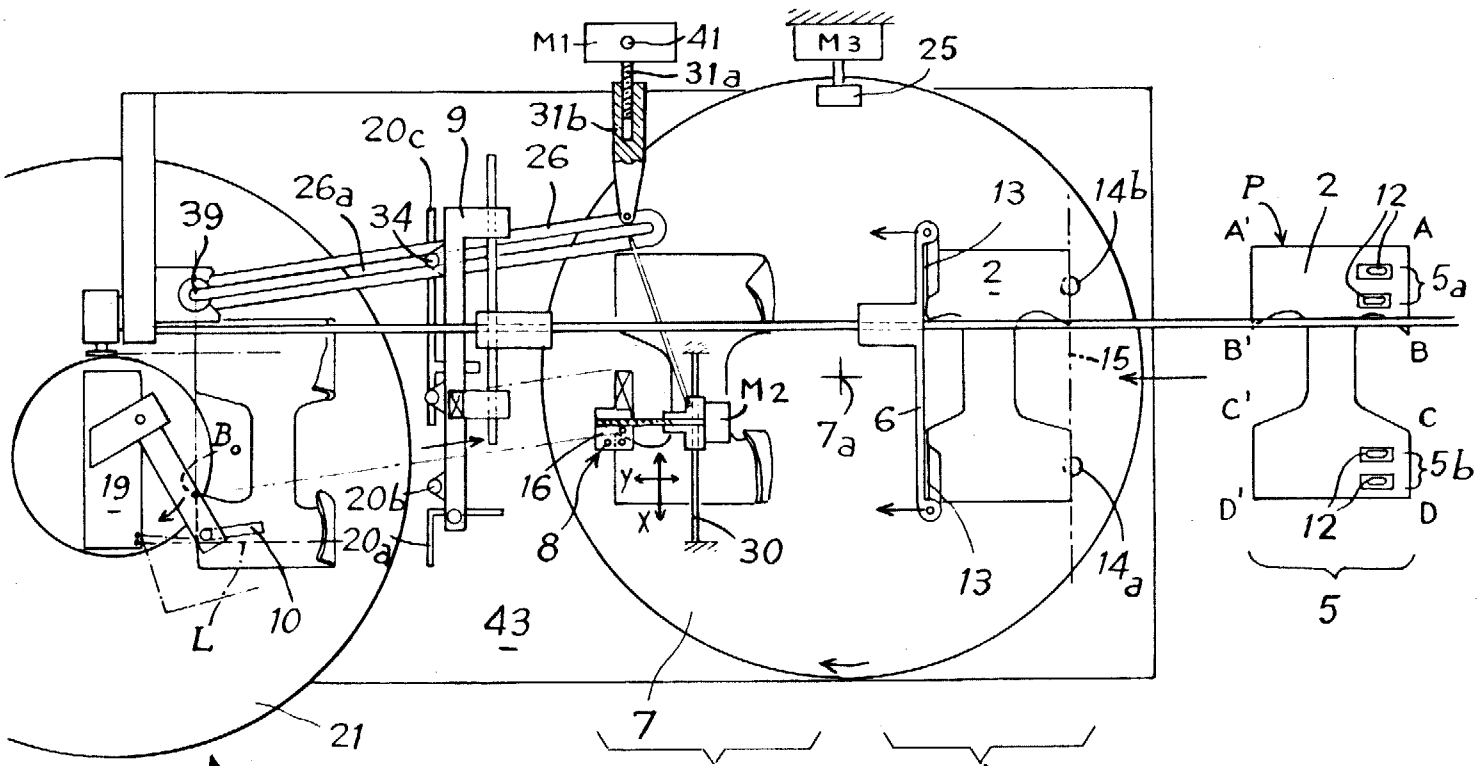
FIG. 3 is a schematic plan view of the entire automatic handling installation of a first embodiment of the invention.
Figure 4:
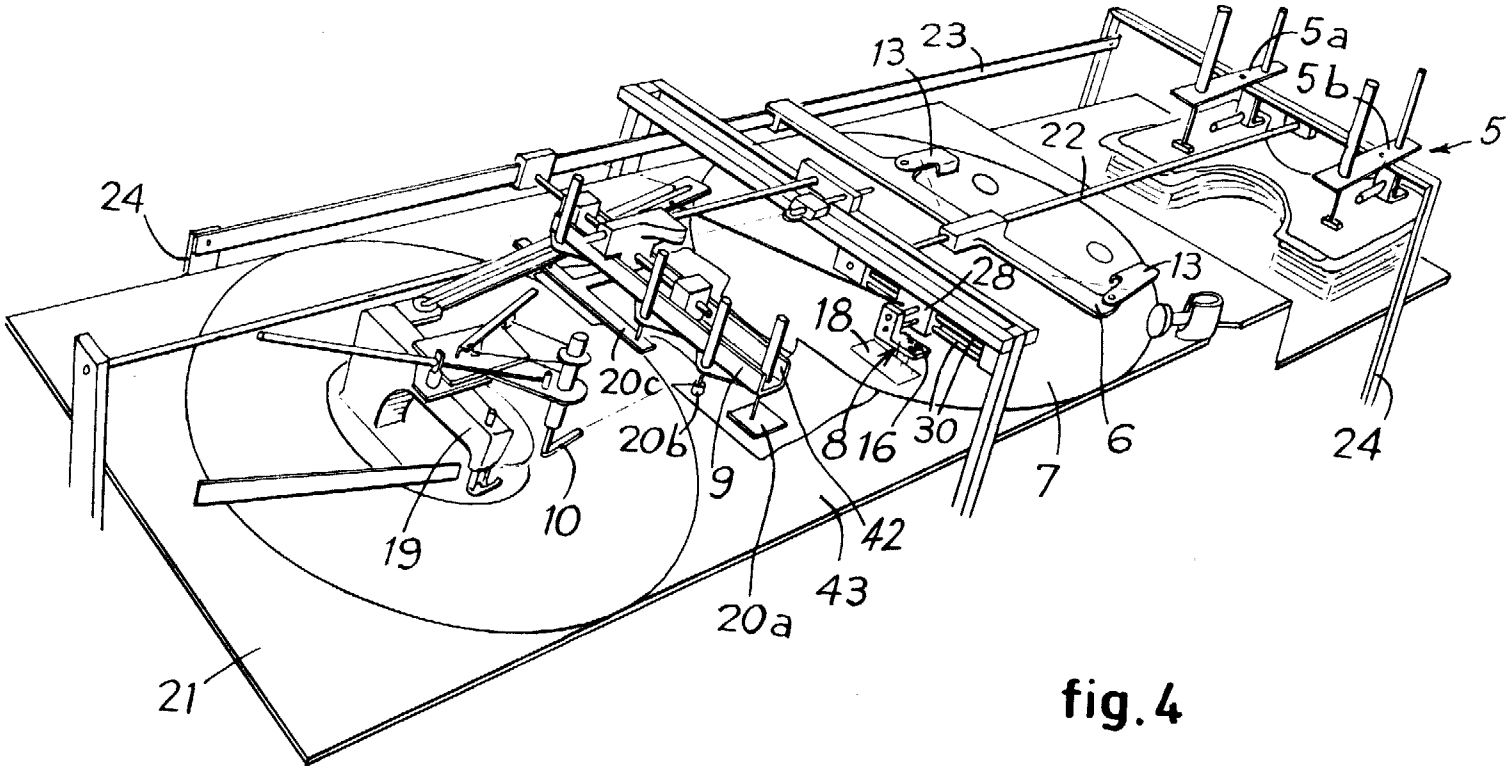
FIG. 4 is a schematic perspective view of the installation of FIG. 3.

In the preferred embodiment, the present invention comprises the sewing assembly illustrated in FIGS. 3 and 4 which operates entirely automatically. To this end, the assembly picks up the pieces 2 one by one, from a pile of pieces; presents automatically and one by one the pieces 2 under the presser foot 3; and sews and borders the concave edges BC or B'C', whatever their outline.

To this effect, the said automatic assembly comprises, in order of use, (refer to FIGS. 3 and 4) orienting means including gripping means 5 comprising two gripping members 5*a* and 5*b* and a flattening carriage 6; a circular transfer table 7 turning about its axis 7*a*; correcting means 8 including locating means for locating on the table 7 the point B', which is the apex of the angle by which the piece 2 will be introduced under the presser foot 3 of the sewing machine; a transfer carriage 9 for bringing the pieces 2 to the sewing station in the desired predetermined orientation; a shoe 10 for introducing the piece 2 under the presser foot 3; and an automatic sewing station 11.

Figure 5A:
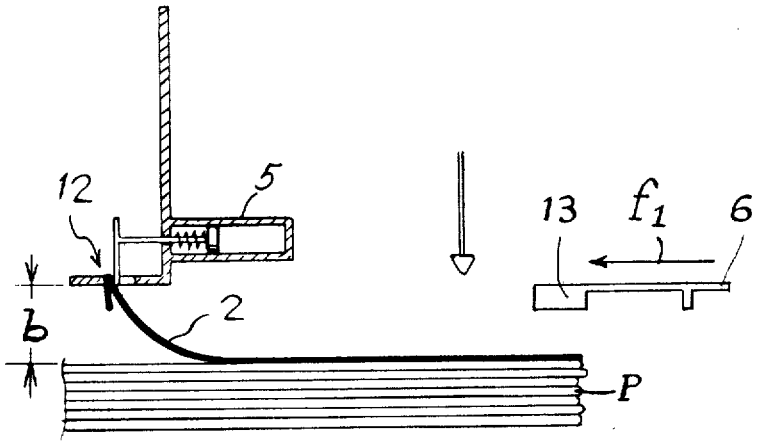
FIGS. 5*a* to 5*c* show the different phases of picking up and laying down flat the pieces to be handled by the installation of FIG. 3.

The two gripping members 5*a*, 5*b*, of the gripping means 5 (FIG. 3) each comprise tongs 12 which grip the topmost piece 2 of the pile of pieces P proximate edge ABCD of the piece and which lift said edge by a small height "b" (FIG. 5*a*).

Figure 5B:
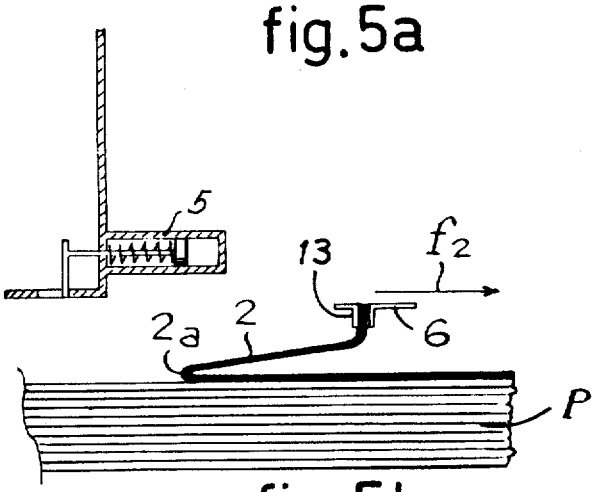
Figure 5C:
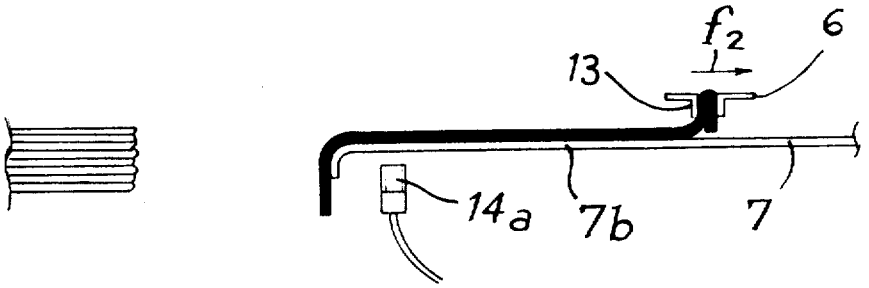

The flattening carriage 6 comprise two relay tongs 13 which take over the piece 2 held by the tongs 12 of the gripping means 5 and deposit it flat on the horizontal turntable. (FIG. 5*a* to 5*c*).

Said relay tongs 13 open independently of each other, at the precise moment when associated edge, respectively A'B' and C'D', passes before a respective detector 14*a*, 14*b*, said detectors being situated along a straight line 15, perpendicular to the sewing line L. This independent opening of the tongs 13 permits placement of the pieces 2 on the turntable 7 in such a way that the edge A'D' is substantially perpendicular to the sewing line L (FIG. 3).

The role of the turntable 7 is to present the deposited piece and particularly reference point B' to the correcting means by a 180° rotation of turntable 7 about its axis 7*a*. When said turntable 7 makes a rotation through 180°, another piece 2 can be laid thereon by the carriage 6, so that the turntable 7 can handle two pieces 2 simultaneously.

The correcting means 8 includes locating means for locating the position of the point B' of the piece 2. By locating two co-ordinates X and Y of said point B' with respect to non-parallel axes of a fixed reference, it is possible to control correcting movement of the transfer carriage 9 as will be explained hereinafter.

The object of such a control is to ensure that the transfer carriage 9, coming to pick up a piece 2 placed on the turntable 7, stops above the piece always in the same relative predetermined position with respect to point B' (the piece 2 being placed on the turntable 7 with the straight line A'D' perpendicular to the sewing axis L).

Figure 6A:
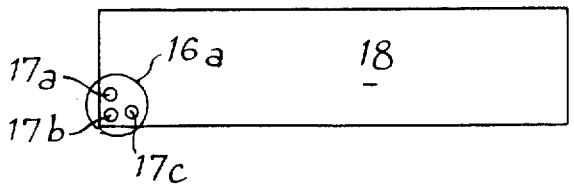
FIGS. 6*a* to 6*d* show the different phases of the operation of detection of the reference point B' of the pieces by the installation of FIG. 3.
Figure 6B:
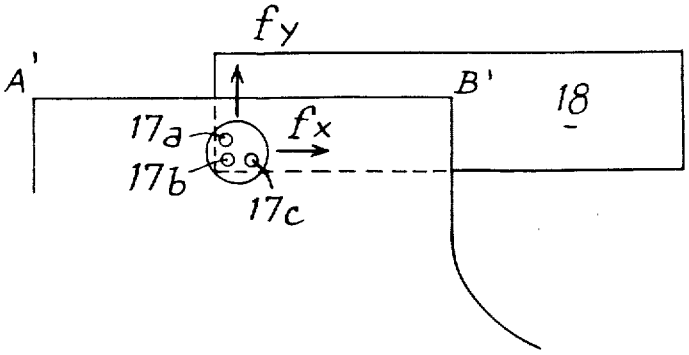
Figure 6C:
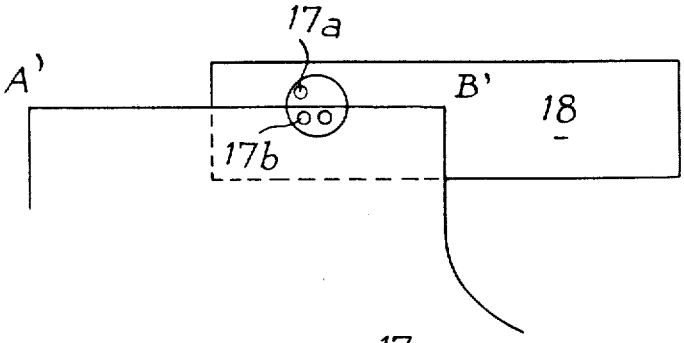
Figure 6D:
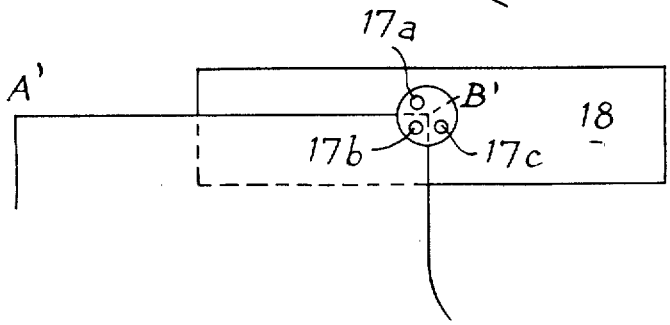

The locating means comprises a detector carriage or common support 16 which supports three photoelectric cells 17*a*, 17*b*, and 17*c* arranged in the preferred embodiment to form a right-angled triangle. Depending on the location information transmitted by the cells, the detector carriage 16 is moved in two directions X and Y, by driving means comprising motors M1 and M2, respectively. Directions X and Y are respectively perpendicular and parallel to the sewing axis L. The aim of these two displacements of the common support 16 is to bring the three cells 17*a*, 17*b* and 17*c* in vertical alignment with point B'. A searching or detection zone 18 is defined as being the portion of the surface of turntable 7 in which the point B' is found by locating means 8 after it is deposited flat on the turntable 7 (FIGS. 6*a* and 6*d*). The extent of the required searching zone 18 depends on the imprecision of the approximate alignment of the pieces 2 in the pile P, as well as on the correction of the angular positioning of the article 2 as it is deposited on the turntable 7 (said predetermined orientation of the edge A'D' by the orienting means).

The transfer carriage 9 picks up the piece 2 and carries it flat towards the sewing machine 19. Transfer carriage 9 comprises three transfer shoes 20*a*, 20*b*, and 20*c* which apply against the piece 2 in order to slide in on the turntable 7 and on subsequent tables, whilst the transfer carriage 9 moves towards the sewing machine 19. The forward displacement of the transfer carriage 9 is designed so that it always brings the point B' into the same predetermined position with respect to the sewing machine 19 and that the predetermined orientation of the edge A'D' is also retained with respect to the sewing line L.

The role of the introduction shoe 10 is to introduce the pieces 2 under the presser foot 3 of the machine 19 so that the tangent of the first centimeters of the edge BC or B'C' of the piece 2 is maintained in line with the sewing axis L. Depending on the shape of the curve BC or B'C' of an article 2, it is possible with a suitable adjustment of the angle of shoe 10 to alter the introductory movement of the piece 2 and thus to present it correctly under the presser foot 3.

The sewing station 11 is provided with special guiding means capable of feeding the sewing machine 19 and of guiding the piece 2 throughout the sewing operation.

The installation described hereinabove operates as follows:

Referring to FIG. 5*a*, the tongs 12 of the gripping members 5*a* and 5*b* pick up and lift by a small height "b", one edge (AD) of the topmost piece 2 of the pile P. Relay tongs 13 of the flattening carriage 6 receive the piece lifted by the gripping members 5*a* and 5*b*, turn it over as shown in FIG. 5*b*, and deposit it flat on the turntable as shown in FIG. 5*c*. FIGS. 5*a*, 5*b* and 5*c* show that gripping means 5 grip the piece 2 proximate the edges AB and CD. Since piece 2 has been turned over by motion of the flattening carriage 6, the edge which will actually be worked at the sewing station will be the edge B'C'. The turning over of piece 2 is done for several reasons, (1) The gripping of a piece 2 by the gripping members 5*a* and 5*b* can only be effected at a certain distance, 10 centimeters for example, from the edge ABCD; (2) It is advisable to turn over the piece 2 situated at the top of the pile P in order to avoid moving the piece 2 situated immediately under when the top piece is being detached from the pile P; and (3) During the flattening , the edge A'B'C'C' is correctly unfolded and deposited flat whereas the edge ABCD can still retain folds after having been deposited on the turntable 7.

FIGS. 5*a* and 5*c* thus show the different phases of the deposit of a piece 2 flat on the turntable 7.

The flattening carriage 6 moves on two parallel guiding rails 22 and 23 integral with a frame 24 of the sewing assembly (FIG. 4). This carriage 6 transfers the piece 2 from the pile P to the turntable 7. This displacement is obtained due to an electric motor and to a chain and pinion power drive, said motor and power drive not being shown in the drawings. The carriage 6 includes two relay tongs 13 whose structure and functioning are described in more detail in copending U.S. Patent Application Ser. No. 148,505 filed May 9, 1980.

FIG. 5*a* shows the advancing movement of the flattening carriage 6 in the direction of arrow $f_1$ toward the piece 2 held by the gripping means 5.

FIG. 5*b* shows the phase of detachment by turning over the piece 2. During this phase, the piece 2 is separated from the other pieces 2 of pile P without displacing these other pieces by the displacement in the opposite direction shown by arrow $f_2$ of the flattening carriage 6 entailing the formation of a fold 2*a* of the piece 2 gripped by the relay tongs 13.

FIG. 5*c* shows the deposit of the piece 2 flat on the turntable 7. Detectors 14*a* and 14*b* are of the optical type and the turntable 7 is made of a transparent material.

During the backward movement of the flattening carriage 6 (arrow $f_2$), the piece 2 leaves the pile P and unfolds by gravity before being deposited flat on the turntable 7. Each one of the detectors 14*a* and 14*b* placed under the turntable 7, triggers the opening of the corresponding relay tongs 13 upon passage of the respective edge A'B' or C'D', thereby releasing the piece 2 in a relatively accurate position on the table 7, partly correcting any rotational misalignment due to its approximate starting position on pile P. This process permits a flattened presentation of the edge A'B'C'D' and orients edge A'D' to be perpendicular with respect to the sewing line L. Said orienting constitutes one of the positioning phases for the correct presentation of the edge B'C' to the machine 19. The orienting of the edge A'D', with respect to the line L, (FIG. 3), helps in the location of point B' by the locating means (which phase is described hereinafter).

As soon as the relay tongs 13 both open, the carriage 6 stops and starts again towards the next piece 2 in pile P which is in the process of being gripped by the gripping means 5. Simultaneously, the turntable 7 rotates through 180° about its axis 7*a* in order to present the edge A'B'C'D' to the correcting means 8.

The role of the turntable 7 is to transfer the pieces 2 from the gripping and flattening means 5 and 6 to the transfer carriage 9 which transfers the article 2 to the front of the sewing machine 19. In continuous operation, turntable 7 receives the underpants pieces 2 taken from the approximative pile P. These pieces are deposited one after the other in that half 7*b* of the turntable 7 adjacent the gripping means 5 while the preceeding piece 2 is laying flat on the other half 7*c* of the turntable 7 above which the locating means 8 is locating the position of the reference point B' by which said piece 2 will be introduced under the presser foot 3. When the position of the point B' has been located, the piece 2 in question is taken up by the transfer carriage 9 and brought towards the sewing machine 19. When the next piece 2 is deposited, the turntable 7 rotates through 180° in order to present the point B' of the next piece 2 within the searching zone 18 of the locating means 8. This rotation is obtained due to a motor M3 which drives the table by acting on its periphery with a drive wheel 25 (FIG. 3).

Means, not shown, prevent the rotation of the table 7 until the preceeding piece 2 is at least partially removed from the turntable 7.

Figure 8:
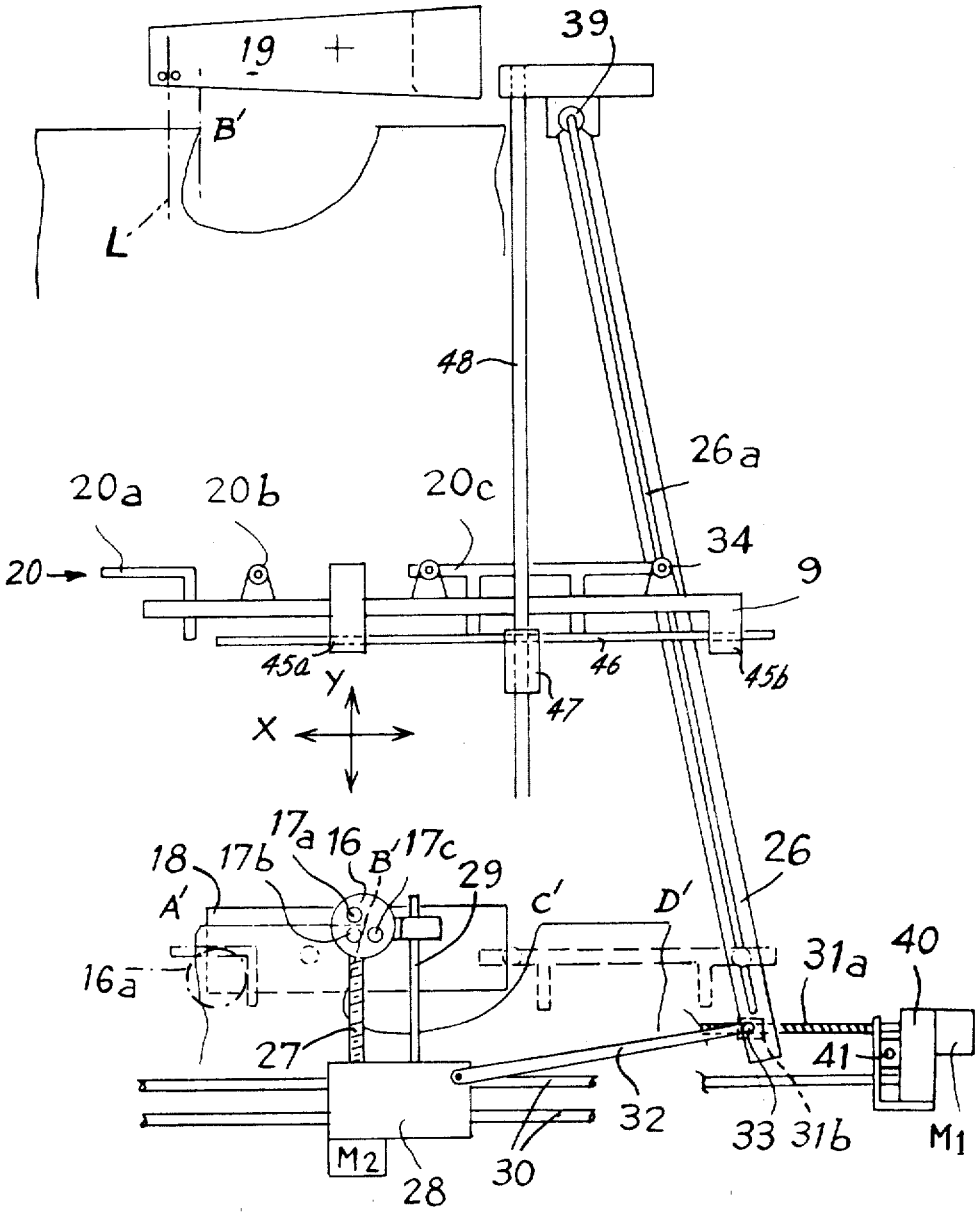
FIG. 8 is a schematic plan view of the correcting assembly of the installation shown in FIG. 3.

FIGS. 3 and 8 show, respectively, the position of the correcting means including locating means 8 in the automatic sewing assembly and the principal details of the correcting means according to one embodiment of the invention.

Said correcting means comprises two essential members, locating means including detector carriage or common support 16 for locating the position of the point B' of a piece 2 (which point is situated within search zone 18), the displacements of which in the directions X and Y are due to the motors M1 and M2; and a movable guiding slide 26 for guiding the transfer carriage 9 between the table 7 and the sewing station 11.

The common support or detector carriage 16 supports the three photoelectric cells 17*a*, 17*b*, and 17*c* arranged in substantially a right-angled triangle, of which triangle the sides adjacent the right angle are parallel to the directions X and Y, respectively. The information simultaneously supplied by the cells 17*a*, 17*b*, and 17*c* control the displacements of the carriage 16 in the direction X and Y as follows:

Referring to FIG. 8, to move in the direction Y, the carriage 16 is connected via a threaded shaft 27 to a correcting block 28; a guiding shaft 29, parallel to the threaded shaft 27 and secured to the block 28, prevents the carriage 16 from pivoting about the threaded shaft 27. Detector carriage 16 can thus move with respect to the correcting block 28 in the direction Y through rotation by motor M2 of threaded shaft 27 which moves the carriage 16 along shaft 29 in the Y direction, said carriage being immobilized in rotation by guiding shaft 29.

The detector carriage 16 moves in the direction X due to motion of correcting block 28, the two members 16 and 28 moving jointly in that direction. Said block 28 moves along two fixed guiding rods 30, orthogonal to the guiding shaft 29, through the action of the threaded shaft 31*a* of motor M1 on a screwnut system 31*b* and a connecting rod 32 which links the correcting block 28 to the nut 31*b*. Said connecting rod 32 and the nut 31*b* are mounted to pivot about the same pivot 33 on the guiding slide 26, the role and description of which are to be given subsequently.

The piece 2 arrives in the searching zone 18 in such a way that the edge A'D' is more or less perpendicular to the sewing axis L. This arrangement was previously obtained by the independent opening of the relay tongs 13 of the flattening carriage 6.

Moreover, with standard designs of underpants, the angle in B is near to a right angle and can vary between 60° and 120°; said angle can thus be detected from three detectors 17*a*, 17*b* and 17*c* arranged in a triangle, as described. In the illustrated example, the detectors are photoelectric cells of the "reflecting" type which detect the absence and the presence of the fabric constituting the piece 2.

In order to explain easily the functioning of the correcting means 8, the absence of fabric under each detector is defined by the condition 0 and the presence of fabric by the condition 1.

For embodiment simplification reasons, the starting position of the detector carriage 16 with respect to the detection zone 18 has been chosen so that said common support 16 finds first the edge A'B' and then the edge B'C'. Said starting position 16a shown in continuous lines in FIG. 6a, and ghosted in FIG. 8 is situtated on the edge of the detection zone 18.

The FIGS. 6a, 6b, 6c and 6d show the principal phases for locating the point B'.

After each operation of locating point B' and once the transfer carriage 9 has picked up the piece 2, the carriage 16 returns to its starting position 16a. In this position the three cells 17a, 17b, and 17c are in condition 0 (FIG. 6a).

Figure 7:
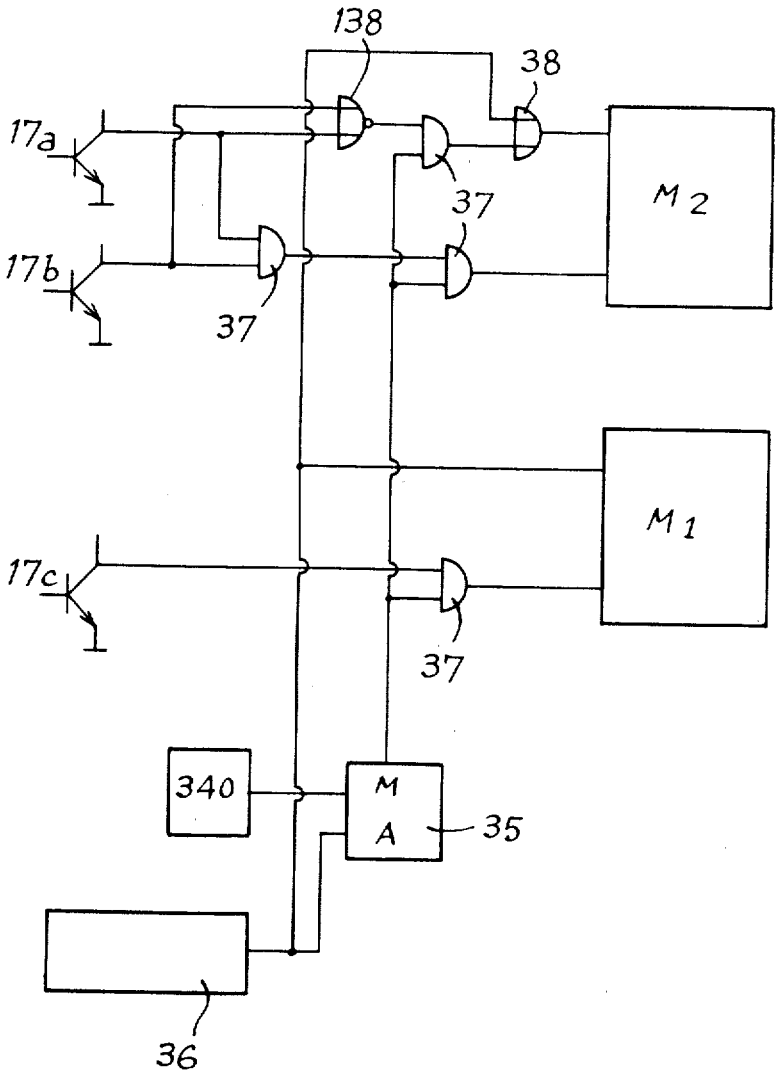
FIG. 7 is a diagram of the electrical circuit controlling the correcting assembly of the installation shown in FIG. 3.

The arrival of another piece 2 in the detection zone 18 by way of the turntable 7 places the three cells in condition 1 (FIG. 6b) and a signal is emitted by a sensor 340 indicating the end of a 180° rotation stroke of the turntable 7, which signal authorizes the start of the detection by the locating means 8. As can be seen in FIG. 7, said signal controls, by triggering the flip flop 35, the rotation in the forward direction of the motors M1 and M2, which rotation moves simultaneously the carriage 16 in FX and FY directions (FIG. 6b). Said rotation of motor M2 moves the carriage 16 in the FY direction until the cell 17a attains the condition 0, which means that the edge A'B' is placed between the verticals of the cells 17a and 17b (FIG. 6c). This change of condition of the cell 17a causes the motor M2 to stop. The motor M1 simultaneously continues to move the carriage 16 in the forward FX direction until the cell 17c comes into the condition 0, thus causing the motor M1 to stop. The location of the point B' is thus achieved when the sensors 17a, 17b and 17c are respectively in the condition 0, 1 and 0. These three conditions also determine the emission of a signal authorizing the removal by the transfer carriage 9 of the piece 2 towards the sewing machine 19 (FIG. 6d).

The motor M2 is once again driving in the forward FY direction, whilst the edge A'B' is sought if the cell 17a returns to the condition 1 during the displacement of the carriage 16 in the direction X. Said motor M2 will turn in the return direction if the two cells 17a and 17b are in condition 0.

According to the circuit illustrated in FIG. 7, the return of the carriage 16 to its position 16a is controlled by an appropriate logic circuit 36 from information indicating motion of the transfer carriage 9 in the direction of the sewing machine 19. This information is, for example, supplied by the end of the lowering stroke of the shoes 20a, 20b, 20c. The logic circuit 36 controls, on the one hand, the "return" rotation of the motors M1 and M2 to the end of return stroke position of said motors, and on the other hand, the return of the flip flop 35 to the initial condition.

The functioning which has just been described is obtained by suitably positioning the gates AND 37, OR 38, and NOR 138 with respect to the circuits 36 and 35, as shown in FIG. 7.

The role of the guiding slide 26 is to guide the transfer carriage 9 between a receiving point and a point of origin of which the co-ordinates depend on the position of the point B' when the piece 2 is situated under the correcting means 8. Said slide 26 comprises a longitudinal groove 26a inside which slides an element 34 which guides the transfer carriage 9.

The end of the slide 26 adjacent the sewing station 11 is mounted to pivot about a fixed vertical axis 39 of the frame 24, which axis is situtated on the side of the sewing machine 19 (FIG. 8). One of the two ends of the groove 26a coincides with the axis of rotation 39 of the slide 26. Said end coincides with the end of stroke position of the runner 34 at the sewing station 11. The transfer carriage 9 is caused to keep a fixed orientation, as will be explained hereinafter. This position of the fixed axis 39 leads, consequently, to the transfer carriage always being brought to the same lateral position with respect to the sewing machine 19. Moreover, and as will be explained hereunder, in the end of stroke position of the carriage 9 above the turntable 7, the transfer shoes 20 always take the same position with respect to the piece 2, oriented beforehand, and situated on the turntable 7, so that the edge A'B'C'D' will always be brought by the transfer carriage 9 in the same predetermined position and orientation with respect to the sewing machine 19.

The guiding slide 26 pivots about the axis 39 under the action of the motor M1 and driving means comprising the screwnut system 31a, 31b, the motor M1 being mounted on a support 40 which can pivot about a vertical axis 41 of the frame 24. Said driving means laterally translates the end of slide 26 as it simultaneously moves the correcting block 28 via the connecting rod 32. The orientation of the rod 26 is imposed by the correcting block 28 having displacements along the X direction determined by the locating means wherein carriage 16 seeks the position of point B', in response to the information transmitted by the photoelectric cells 17a, 17b, and 17c.

Figure 9:
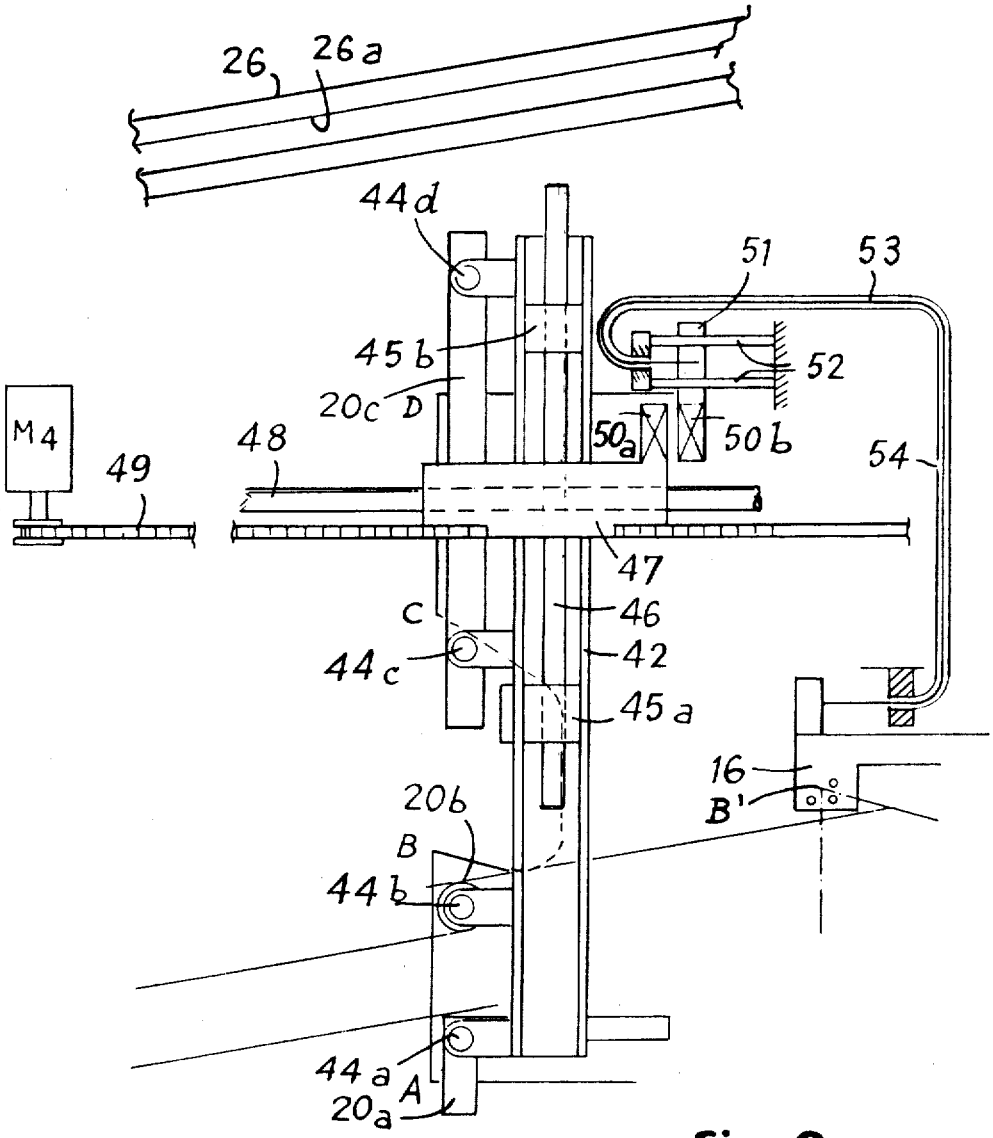
FIG. 9 is a detailed plan view of a portion of the correcting assembly of the installation shown in FIG. 3.

FIG. 8 shows the general lay-out of the transfer carriage 9 and its position with respect to the correcting means 8. FIG. 9 is a detailed view of the transfer carriage 9 and correcting means 8.

Transfer carriage 9 is comprised of a U-shaped frame 42 supporting three conveying shoes 20a, 20b, 20c, which are applied on the piece 2 along the edge A'B'C'D' and transfer it by sliding it over the turntable 7 and over the horizontal guiding table 43 which follows it, up to the sewing machine 19, (FIG. 3). The shoes are selectively applied on the piece 2 by means of jacks 44a, 44b, 44c, 44d.

Referring to FIGS. 8 and 9, the generally U-shaped frame 42 is fixed by two sliding bearings 45a and 45b so as to be able to move along a fixed axis 46 on a support 47 which slides along a fixed guiding axis 48 parallel to the sewing axis L. Said U-shaped frame 42 is immobilized in rotation about the axis 48 by the guide element 34 (said guide element 34 sliding in the groove 26a of the guiding shaft 26).

The displacement of the carriage 9 in the direction Y is obtained through the action of a motor M4 and of a belt and pulley power drive 49 which drive the carriage 9 axially along support 47; during this displacement, the frame 42 can move in the direction X via the guiding element 34 whenever the guiding slide 26 is inclined with respect to the axis 48. As a result, the U-shaped frame 42 which is supported by the axis 46 and guided in the groove 26a by the guiding element 34, moves in a direction parallel to the axis of the guiding slide 26 while remaining perpendicular to the guiding axis 48 of the sliding support 47.

The positioning of the transfer carriage 9 with respect to the located piece 2 is accomplished as follows:

When the detector carriage 16 has located the point B' of piece 2, the transfer carriage 9 comes into position above piece 2 in relation to the position of the point B' indicated by the detector carriage 16.

In order to carry away located pieces 2 and to present them always in the same predetermined position to the sewing machine 19, the transfer shoes 20a, 20b, and 20c must necessarily be positioned and applied on the pre-oriented pieces 2, always in the same relative position with respect to point B', i.e., always on the same predetermined gripping zones of the pieces 2.

The stop position of the transfer carriage 9 in its return stroke is transmitted by the detector carriage 16 to memory means comprising a stop detector 50 constituted by two elements 50a and 50b, one of which 50a is mounted on the support 47 of the transfer carriage 9, the other 50b being integral with a small movable carriage 51 (FIG. 9).

Said movable carriage 51 slides along two fixed axes 52 and moves in the direction Y under the action of the detector carriage 16 via a coaxial Bowden cable 53 guided in a fixed sleeve 54. In this way, when the detector carriage 16 of the locating means has located the position of point B', it transfers that information directly and simultaneously the ordinate Y of the point B' to the end-of-stroke detector 50b which receives and mechanically remembers the positioning information transmitted from the locating means. The stop position in the return of the the transfer carriage 9 is therefore linked to the position of the point B' through the action of the detector 50; the carriage 9 stops in an accurate position with respect to the piece 2 when the two elements 50a and 50b coincide. Said stop is for example obtained by the interruption of a signal controlling the motor M4, which interruption is caused by the said elements 50a and 50b coming into mutual contact.

To sum up, depending on the position of the point B' of the pre-oriented piece 2 deposited on the turntable 7, the transfer carriage 9 is guided by the guiding slide 26 when on its return stroke and stops in the accurate position with respect to the edge A'B'C'D' and particularly point B' through the action of the stop detector 50.

At the end of the detection operation, the transfer carriage 9 takes charge of the located piece 2 and removes it towards the sewing machine 19. Another piece 2 is then brought under the detector carriage 16 which will, once again, search for the position of point B'. This search which starts and goes on through the forward stroke of the transfer carriage 9, involves displacements of the carriage 9 in the direction X (simultaneous orientation of the guiding slide 26), but these do not perturb the sliding advance of the piece 2 towards the sewing machine 19 which due to the location of vertical axis 39 of guiding slide 26 can only arrive at the same spot in front of the machine 19 regardless of its path.

The mechanized handling assembly described hereinabove makes it possible to position accurately a piece 2 (underpants) at the entrance of a sewing machine 19, said piece being taken from a pile P where the pieces 2 are roughly stacked and present themselves in a more or less accurate orientation.

The solution to this problem, according to the first embodiment of the present invention thus consists in displacing the pieces by:

(1) rotating the piece deposited flat, about an axis perpendicular thereto by first locating a conspicuous reference line on said piece (the edge A'B'C'D' in the case of underpants) and then orienting the said piece with respect to a reference direction (the sewing axis L);

(2) effecting a correcting translation of the piece deposited flat, by locating a conspicuous point of said piece (the point B' for the underpants).

ALTERNATIVE EXEMPLARY EMBODIMENTS

Figure 10:
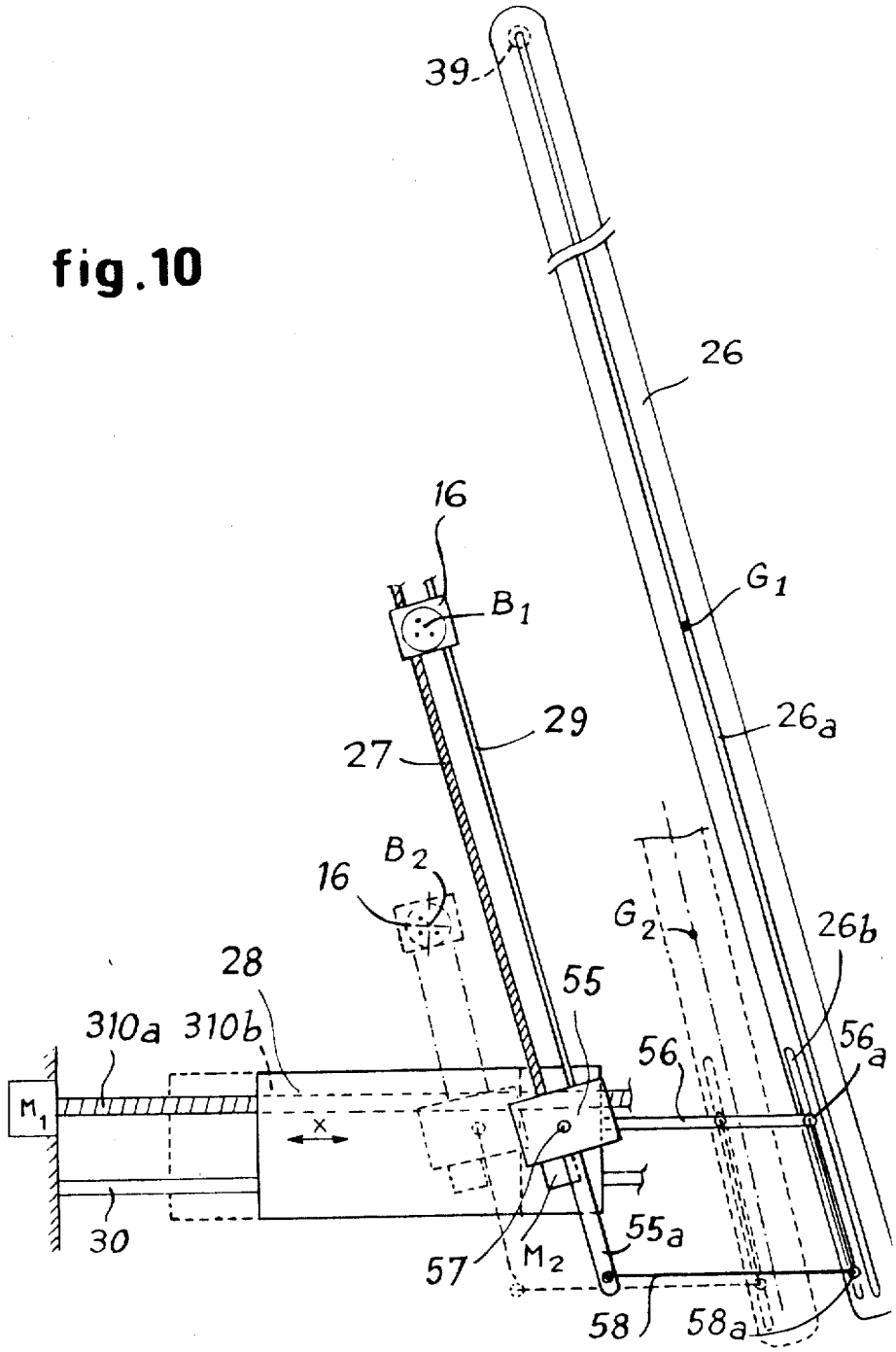
FIG. 10 is a schematic plan view of a second embodiment of the correcting assembly for an installation according to the invention.

FIG. 10 shows a variant of the correcting means 8. According to this variant, the guiding slide 26 is joined to a frame 55 which supports the detector carriage 16 by a jointed and deformable parallelogram system, one of the sides 56 of which remains in alignment with a fixed longitudinal axis parallel to the direction X and transmits to the guiding slide 26 the X movement of the correcting block 28. The side 56 of the connecting parallelogram is a rigid rod which is, on the one hand, fixed to the block 28 and, on the other hand, connected to the guiding slide 26 for pivoting about an axis 56a which is itself adapted to slide along the guide slide 26 in a second longitudinal groove 26b of the latter. The parallelogram includes a second side 58 parallel to the side 56 and constituted by a rigid rod pivotally mounted, on the one hand, on the free end of an arm 55a extending from the frame 55 and, on the other hand, on the guiding slide 26 about an axis 58a which is itself adapted to slide along the second groove 26b of the guiding slide 26. The frame 55 of the carriage 16 pivots about an axis 57 integral with the correcting block 28 thus is oriented with respect to said block 28 under the action of the two parallel rods 56 and 58 of the parallelogram when the correcting block 28 moves in the X direction and causes the guiding slide 26 to pivot about its axis 39. By deforming itself in such a way that the sides 56 and 58 remain parallel to the direction X, the parallogram affords the possibility of orienting the guiding slide 26 in parallel with threaded shaft 27 of the detector carriage 16. It is also noted that the motor M1 acts directly on the block 28 by way of the screwnut system 310a–310b and that the support of the motor M1 is fixed.

FIG. 10 shows two positions of the correcting means, the first shown in solid outline and identified as G1, the second shown ghosted and identified as G2, which correspond to two different positions of the point B', referenced as B1 and B2. For these two points B1, B2 of the same abscissa and of different ordinates, the stop positions G1, G2 of the runner 34 have absolutely the same abscissa, and the transfer carriage 9, not shown, comes into absolutely the same position with respect to the two pieces 2.

This second embodiment thus presents at end-of-stroke of the carriage 9, each point B' and as a result each piece 2 in exactly the same position and orientation with respect to the sewing machine 19.

Figure 11:
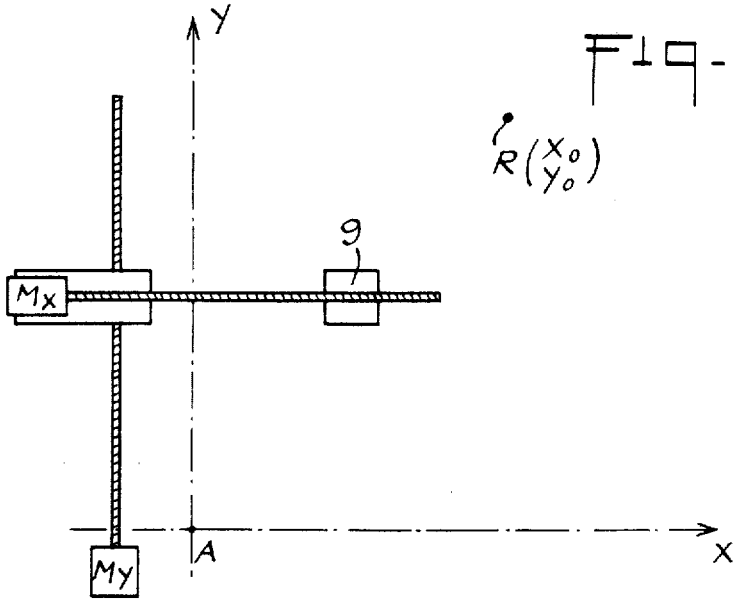
FIG. 11 is a schematic plan view of a portion of the correcting assembly of FIG. 10.

It should be noted that the electromechanical system formed by the guiding slide 26 and the stop detector 50 constitute altogether, means for adjusting the stop position of the carriage 9 above the turntable 7 and means for storing the information constituted by the said stop position. Indeed, although the location of the position of the point B' by the locating means 16, 17, M1 and M2 is completed when the transfer carriage 9 is still on its forward run towards the sewing station, the information constituted by the stop position to be occupied by the carriage 9 above the table 7 are stored by the accurate positioning of the guiding slide 26 and the stop detector 50. Said electromechancial system can be replaced by a system in which the carriage 9 and 16 are mechanically independent one from the other. FIGS. 11 to 13 show an example of this last system: in FIG. 11, the carriage 9 is movable in X and Y directions and it is displaceable in each of these directions by the action of a respective motor MX and MY, whereas, from the co-ordinates of the point B' measured by the locating means 16, 17, the coordinates Xo and Yo of the point R of end-of-return-stroke position of the transfer carriage 9 are worked out in a calculation circuit 59; said co-ordinates Xo, Yo are stored in an electronic device 60.

Figure 12:
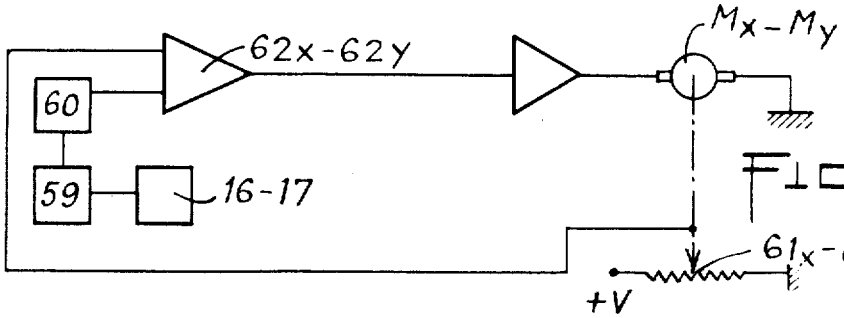
FIG. 12 is a diagram of the electrical circuit controlling the correcting assembly shown in FIG. 11, according to an embodiment of the invention.

The motors Mx and My are controlled by a servo-loop such as that shown in FIG. 12, so that the transfer carriage 9, arriving from its stop point A at the sewing station 11, comes into position above the turntable 7 at a point R. The position (x,y) of the transfer carriage 9 on its return stroke is determined by a potentiometer 61*x* and 61*y* respectively, and said values x and y are each compared in comparison meter 62*x* and 62*y* with the corresponding value Xo, Yo. The signal Xo-x, Yo-y issued by the comparison meter, 62*x* and 62*y* respectively, control the corresponding motor Mx and My.

Figure 13:
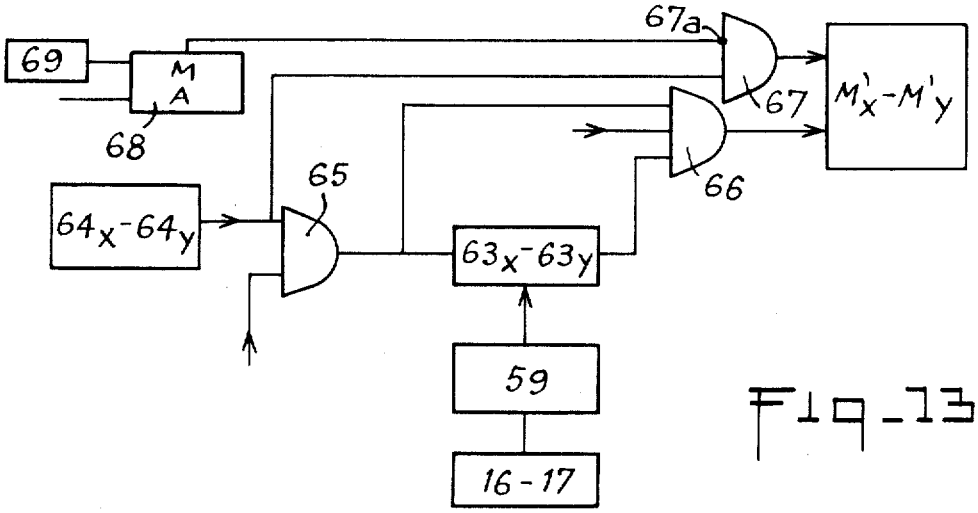
FIG. 13 is a diagram of the electrical circuit controlling the displacement of the driving carriage, according to an embodiment compatible with the correcting assembly shown in FIG. 11.

Another solution, shown in FIG. 13, consists in using step-by-step type motors M'x and M'y instead of the motors Mx and My. In this case, the locating means 16–17 transmit the co-ordinates of point B' to the calculation circuit 59, and the latter adjusts the contents of a reversible counter 63*x*, 63*y* to a value proportional to Xo, Xy respectively. A pulse generator 64*x*, 64*y* controls the motor M'x, M'y through an enabling AND gate 65, and a stop AND gate 66, until the number of pulses issued by the said generator to the motor M'x, M'y reaches the preselection of the counter 63*x*, 63*y*; at that moment, the latter ceases to apply a signal to the second input of the stop AND gate 66 taking then the closed position.

The forward displacement of the transfer carriage 9 towards the sewing station 11 can be controlled by a circuit similar to that shown in FIG. 12 and in which the co-ordinates Xo and Yo are replaced by the co-ordinates 0,1, 0, of the original point A.

This displacement can also be controlled by the circuit shown in FIG. 13, whenever step-by-step type motors M'x and M'y are used. Pulses are applied to the input IN of a motor M'x, M'y from the generator, and respectively, 64*x*, 64*y* through an enabling AND gate 67 of which the enabling input 67*a* receives the signal issued by a flip-flop which is triggerable by means of an enabling signal issued for example by a logic circuit 69 when the condition of the cells 17*a*, 17*b*, 17*c* is respectively 0, 1, 0. The carriage 9 stops automatically at point A, the step-by-step motors being equipped with end of stroke contacts, not shown which correspond to the position of the carriage 9 at said point A.

Having thus described a preferred and certain alternative exemplary embodiments of the handling installation of the present invention, it should now be apparent to those skilled in the art that the various objects and advantages of this invention have been attained by these embodiments and that various other modifications, variations, and equivalent constructions may be made in view thereof and fall within the scope and spirit of the present invention which is limited only by the following claims.

We claim:

1. A handling installation for transporting a piece of fabric from a first station in an approximate position to a second station in a predetermined position, comprising:

a generally planar surface extending between the first and the second stations on which the fabric can slide;

a transfer carriage movable over the planar surface between a first position wherein the transfer carriage is at the first station and a second position wherein the transfer carriage is at the second station, gripping means carried by the transfer carriage and selectively movable into and out of gripping contact with the fabric resting on the planar surface, the second position having a predetermined fixed position, the first position being translatable along two non-parallel directions of a plane parallel to the planar surface;

locating means mounted above the planar surface to supply position information relative to the position of a predetermined reference point of the fabric at the first station; and correcting means operably connected to the transfer carriage for adjusting the first position of the transfer carriage in the two directions in response to the position information from the locating means so that the position of the transfer carriage in the first position relative to the position of the fabric at the first station is identical to the position of the transfer carriage in the second position relative to the predetermined fixed position of the fabric at the second station.

2. The installation of claim 1 wherein the locating means comprises:

at least three detectors mounted on a common support which is movable in translation in a locating plane parallel to the planar surface, along each of two non-parallel axes of the locating plane, the detectors being positioned to form a triangle in a plane parallel to the planar surface, two sides of the triangle being parallel, respectively, to each of the axes of translation of the common support, driving means for moving the common support independently along each of the axes of translation in response to signals from the detectors, whereby the common support only stops when it faces the apex of an angle formed by the outline of the fabric, the apex constituting a predetermined reference point of the fabric, and means for transmitting position information of the position of the common support relative to the axes of translation, one of the axes of translation being parallel to the local tangent of one edge of the outline of the fabric proximate the reference point.

3. The installation of claims 1 or 2 further comprising memory means for storing and mechanically remembering the position information.

4. The installation of claim 2 further comprising:

a guiding slide extending substantially parallel to the planar surface from the first station to the second station and mounted for rotation about a fixed axis situated at the second station, a guiding element on the transfer carriage for guiding the transfer carriage along the guiding slide, the second position of the transfer carriage at the second station being a position in which the guiding carriage element is aligned coincident with the fixed axis of rotation of the guiding slide.

5. The installation of claim 4 wherein the correcting means further includes means for adjusting:

(a) the rotational position of the guiding slide about the fixed axis in response to the position information, so that the distance between the fabric in the first station and the guiding slide remains substantially equal to a reference distance existing between the guiding slide and the fabric when the latter is at the second station in a predetermined position, and (b) the first position of the transfer carriage at the first station in response to the position information so that the distance between the fabric at the first station and the transfer carriage in the first position is substantially equal to the distance between the fabric at the predetermined position at the second station and the carriage in its second end-of-stroke position.

6. The installation of claim 5, further comprising orienting means for taking a piece of fabric in an approximate orientation from a third station and for disposing it in a predetermined orientation on the planar surface at the first station.

7. The installation of claim 6 wherein the orienting means comprises at least two orientation detectors, each one positioned in a respective detector point of the planar surface proximate the first station and each one detecting the presence of the fabric at the point, multiple gripping means for gripping the fabric at the third station in an approximate position by at least two gripping points on an edge of the fabric and for moving the displaced edge above the planar surface and low enough so that a second reference edge of the fabric trails on the planar surface to be detected by each one of the detectors, each of the multiple gripping means being controlled independently by a respective detector so as to release, independently one from the other, each of the gripping points as soon as the detector proximate the gripping point detects the passage of the reference edge.

8. The installation of claim 7 wherein part of the planar surface situated at the first station has a circular area that pivots about its axis, the installation further comprising driving means for driving the circular area in rotation.

9. The installation of claim 4 wherein the correcting means further comprises a connecting rod pivotally joined on one end to the part of the guiding slide situated at the first station and, on the other end to a support carriage guided transversely to the direction of displacement of the fabric on the planar surface, the support carriage being adapted to follow the displacement of the common support of the locating means in the transverse direction.

10. The installation of claim 9 further comprising a support slide mounted on the support carriage, means for mounting the common support for movement on the support slide.

11. The installation of claim 10 further comprising a jointed parallelogram system for keeping the guiding slide and the support slide in constant parallel relationship.

12. A handling installation for bringing to a second station, in a predetermined and fixed orientation and position, a piece of fabric or other material in sheet form, which is situated in a first station in a predetermined orientation and an approximate position comprising:

a frame;

a table carried by the frame including thereon the first and second stations;

transfer means for moving the piece from the first station to the second station, said transfer means comprising a guiding slide extending substantially in parallel to the table from the first station to the second station and mounted on the frame for rotation about a fixed axis situated at the second station, a driving carriage which is movable in parallel to the table from the first station to the second station, said carriage being engageable with the piece on the table and being guided along the slide by an element of said carriage which is engaged in said slide, the end-of-stroke position of the carriage at the second station being a position in which the carriage element is proximate the fixed axis of rotation of the slide, and means for positioning the driving carriage with respect to the piece;

orientation means for depositing on the table at the first station a piece taken from a third station in an approximate position and for guiding it into said predetermined orientation; and positioning means for defining the position of a reference point of the piece at the first station comprising at least two detectors, each one placed in a respective detecting point of the table at the first station, and each one detecting the presence of the piece at said point, and gripping and transfer means for gripping the piece situated at a third station in an approximate position by at least two gripping points on an edge of said piece and for moving that edge above the table and low enough so that another reference edge of the piece trails on said table in order to be able to be detected by each one of said detectors, said gripping and transfer means being controlled by the detectors so as to release, independently from one another, each of the gripping points as soon as the detector adjacent the respective gripping point detects the passage from its proximity of the reference edge.

13. A handling installation for bringing to a second station, in a predetermined and fixed position, a piece, and in particular a supple piece in sheet form such as fabric, situated in a first station in an approximate position, comprising:

a sliding plane extending between the first and second station upon which the piece can slide;

a frame extending above said sliding plane;

a guiding slide which is pivotally mounted to said frame at a point proximate said second station;

a transfer carriage carried by said frame which is movable over the sliding plane and guided by said guiding slide between a first end-of-stroke position wherein the transfer carriage is at the first station and a second end-of-stroke position wherein the transfer carriage is at the second station, said transfer carriage including means which are moveable into and out of gripping engagement with the piece resting on the sliding plane, said second end-of-stroke position being fixed relative to the sliding plane, said first end-of-stroke position being adjustable in a plane parallel to the sliding plane;

a correcting block slidably mounted on the frame to slide in a direction transverse to the direction of displacement of a piece on the sliding plane;

a support carriage pivotally mounted to said correcting block;

positioning means carried by said support carriage for determining the position of the piece at the first station with respect to a fixed reference point in the plane of the sliding plane and for causing said correcting block to slide on the frame in response to said determination;

memory means for storing positioning information supplied by the positioning means;

a connecting rod for joining the support carriage and correcting block to the guiding slide and being mounted such that its longitudinal axis remains fixed and substantially parallel to an axis within the sliding plane which is transverse to the direction of motion of the piece;

a guiding shaft rigidly mounted to said support carriage and positioned substantially in alignment with the longitudinal axis of the guiding slide, said positioning means being slidably mounted on said guiding shaft;

an intermediate support which is rigidly mounted to and extends from the support carriage;

a second connecting rod parallel to the first connecting rod which connects another portion of the guiding slide to said intermediate support thereby pivoting the support carriage about its pivotal connection with the correcting block in response to rotations of the guiding slide about its pivot point proximate the second station; and correcting means for adjusting the first end-of-stroke position of the transfer carriage in response to the stored positioning information and for pivotally moving said guiding slide so that the relative position of the transfer carriage in said first end-of-stroke position with respect to the position of the piece at the first station is identical to the relative position of the transfer carriage at the second end-of-stroke position with respect to the predetermined fixed position of the piece at the second station;

whereby a jointed parallelogram is formed by said intermediate support and said portion of the guiding slide as two opposing sides and said first and second connecting rods as the other two opposing sides of said jointed parallelogram.

* * * * *